US006165014A

United States Patent [19]

Kao et al.

[11] Patent Number: 6,165,014

[45] Date of Patent: Dec. 26, 2000

[54] CONNECTOR SOCKET

[76] Inventors: Chang-Chi Kao, 2F, NO.23 Lane 95, yeong-an street, San-Shya town, Taipei Shian; Chia-Hao Chang, 12F, NO.110-1 Goan-Chyan E. Rd., Panchiao city, Taipei shian, both of Taiwan

[21] Appl. No.: 08/949,391

[22] Filed: Oct. 14, 1997

[30] Foreign Application Priority Data

Oct. 14, 1996 [TW] Taiwan ..... 85215759

[51] Int. Cl.[7] ..... H01R 13/648

[52] U.S. Cl. ..... 439/607

[58] Field of Search ..... 439/607–610, 439/108, 101

[56] References Cited

U.S. PATENT DOCUMENTS 4,838,811 6/1989 Nakamura et al. ..... 439/607
5,083,945 1/1992 Miskin et al. ..... 439/607
5,207,597 5/1993 Kline et al. ..... 439/607
5,688,145 11/1997 Liu ..... 439/607
5,738,544 4/1998 Davis ..... 439/607

*Primary Examiner*—Hien Vu
*Attorney, Agent, or Firm*—Donald C. Casey

[57] ABSTRACT

An improved connector socket comprises a seamless front housing that has square or rectangular cross section. The perimeter of the front housing is provided with a plurality of recesses that are directed inward to the housing. The front portion of the front housing is provided with at least one receptacle that is provided with a plurality of positioning tabs that has a circular contour. The rear housing is connected to the rear portion of the front housing and which has a square or rectangular cross section. The rear housing defines left and right walls that are provided with at least an opening. The top wall of the rear housing has a longer length than that of the left and right walls and a bending cutout is disposed adjacent to the left and right walls. The rear end of the top wall is also provided with a retaining groove at both sides. The bottom wall of the rear housing has a shorter length that equals to the length of the left and right walls.

1 Claim, 12 Drawing Sheets

( prior )

( prior )

( prior )

CONNECTOR SOCKET

FIELD OF THE INVENTION

The present invention relates to a socket, more particularly, to an improved connector socket in which the housing of the socket is rigid and the connector received thereof can be firmly engaged and supported.

DESCRIPTION OF PRIOR ART

The connector has been widely applied on the computer, its peripherals, printed circuit board of the appliances. As the electronic and electrical products have been quickly developed, the connector socket has also been modified frequently to meet the requirements of the market.

1. Referring to FIG. 13, a conventional connector socket is described. This conventional connector socket includes an upper socket A made from insulating plastic material. The socket A is extended with a plurality of conducting pins A1 at rear portion.

The lower socket B is also made from insulating plastic material and is provided with a plurality of conducting pins B1. Those conducting pins A1, B1 are extended downward over the lower socket B and which can be inserted into the appliance.

An L-shape plate C is attached to the rear portion of the upper and lower sockets A, B. The front portion of the L-shape C is provided with openings C1, C2 and the opening C1 can be selected to from a terminal C3 by punching. The terminal C3 serves for grounding when it is attached to the printed circuit board and for retaining thereof.

A plurality of threaded holes E1 that are formed on the upper and lower sockets A, B by means of drilling and punching. Accordingly, the upper and lower sockets A, B can be fixedly engaged with the L-shape plate C. The threaded holes E1 can be used to attach the socket onto the appliance by means of screws.

However, this conventional socket has a complicate configuration and which is inconvenient for manufacturing. Besides, the computer and its peripherals feature a compact configuration and the conventional socket has been phased out resulted from its complicated configuration.

2. Referring to FIGS. 12A, 12B, a newly developed and advanced connector socket is described. Even this connector socket has not been widely developed; it has been referred to as the Universal Serial Bus (USB). The philosophy of this USB is to meet the compact and simplification of the components within the computer. The socket defines a shell A having four sidewalls A1, A2, A3, and A4. The bulk size of the shell A is comparatively smaller than that of the conventional socket. The front wall is at least provided with a receptacle B for receiving and retaining a connector therein. The lower portion of the shell is provided with a plurality of connecting legs C that can be connected to the printed circuit board by soldering. The mount F of the pins F1 is fixedly disposed within the shell A. The pin F1 that extends longitudinally can be inserted onto the printed circuit. However, this advanced connector socket can be concluded with the following defects.

(A). Each of the sidewalls A1, A2, A3, and A4 is provided with resilient tabs D that has a V-shape and directs downward and slantways. By the provision of the resilient tabs D, the sidewall of the connector E can be fixedly retained. However, the distance L between the resilient tab D and the facing surface of the shell A is quite short, the repetitive inserting and removal of the connector may result the early fatigue or deformation of the resilient tab D. When early fatigue or deformation of the resilient tab D is experienced, the engagement with the connector E will be negatively influenced. Poor conducting effect is therefore occurred.

(B). The configuration of the shell A is formed by repetitively punching and folding, accordingly, there is a seam A5 between two adjacent sidewalls A1, A2, A3, and A4, respectively. Even the seam A5 can be punched with positioning points, the overall rigidity of the shell A will be considerably reduced. Specially, the positioning point will be moved or loosened during the assembling, as a result, a traverse displacement of the pin F1 will be occurred. Especially when the mount F having pins F1 is fixedly disposed within the shell A, the stability of it will be reduced. Furthermore, when the connector E is repetitively inserted and removed, the mount F will be displaced more or less. As a result, it can not be accurately disposed onto the printed circuit board G of the personal computer. This defect shall be overcome eventually.

SUMMARY OF THE INVENTION

It is the objective of this invention to provide an improved connector socket in which the rigidity of the housing is enhanced such that the conducting pin assembly disposed therein can be firmly and fixedly supported. The connector can be repetitively inserted and removed without any poor connection therebetween.

BRIEF DESCRIPTION OF THE DRAWINGS

In order that the present invention may more readily be understood the following description is given, merely by way of example with reference to the accompanying drawings, in which.

DETAILED DESCRIPTION OF PREFERRED EMBODIMENT

Figure 1:
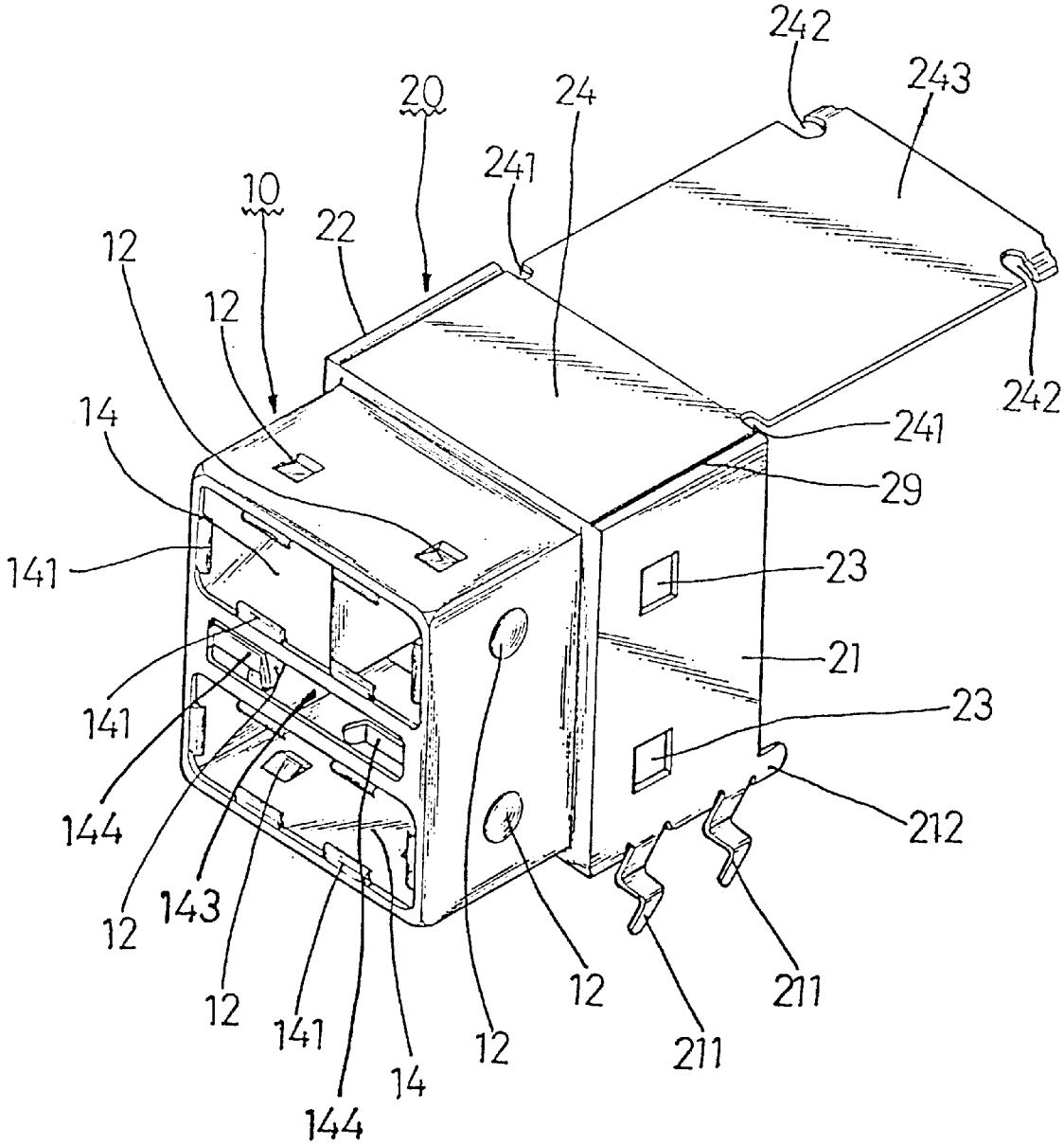
FIG. 1 is a perspective view of the connector socket made according to the present invention.
Figure 2:
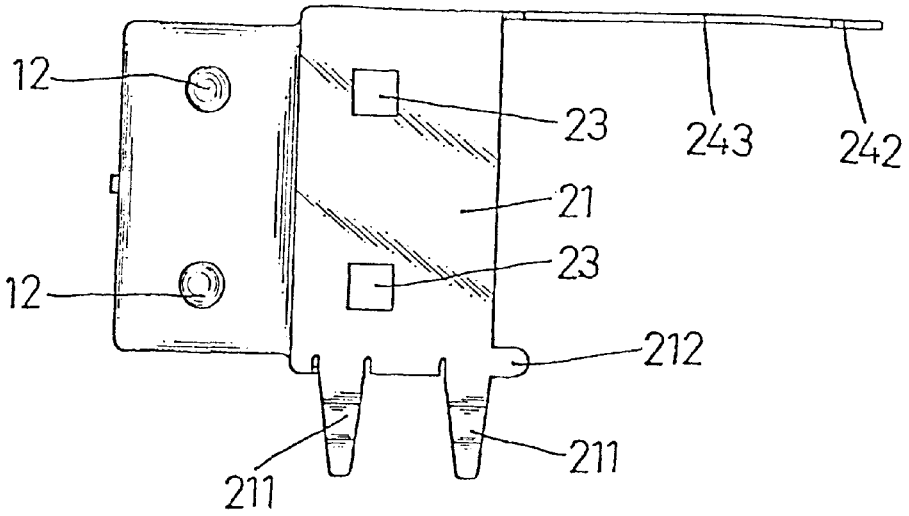
FIG. 2 is a side elevation view of the connector socket shown in FIG. 1.
Figure 3:
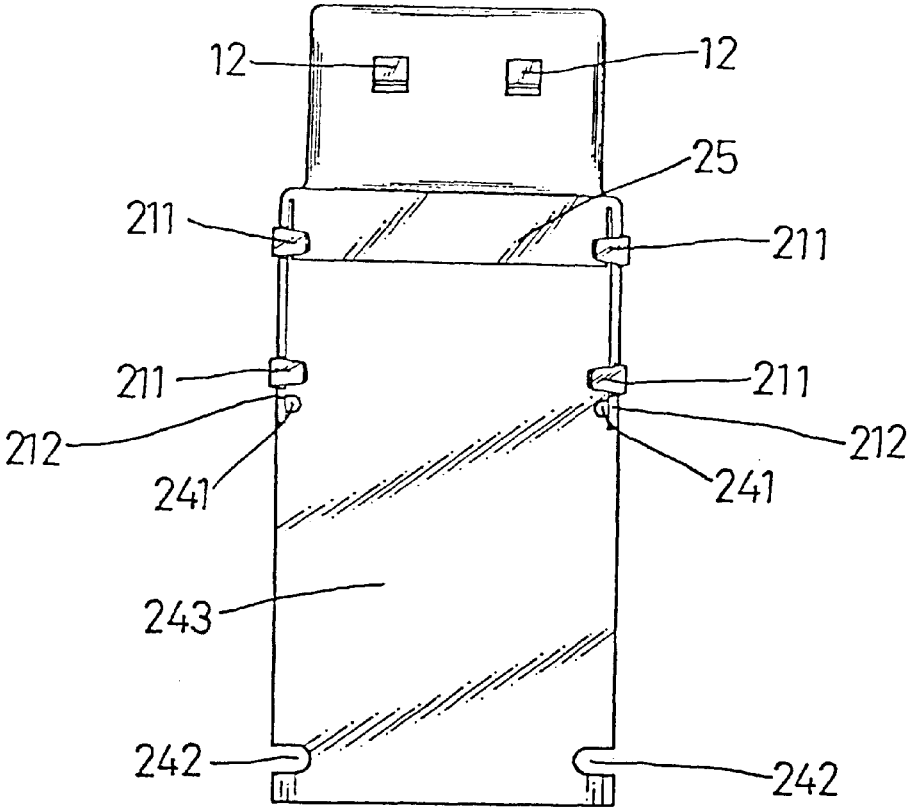
FIG. 3 is a bottom view of the connector socket shown in FIG. 1.
Figure 4:
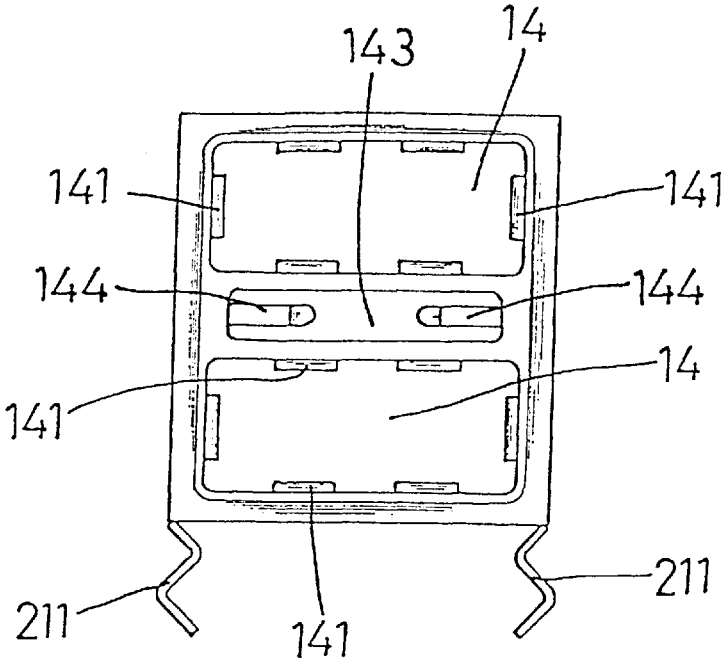
FIG. 4 is a front view of the connector socket shown in FIG. 1.
Figure 5:
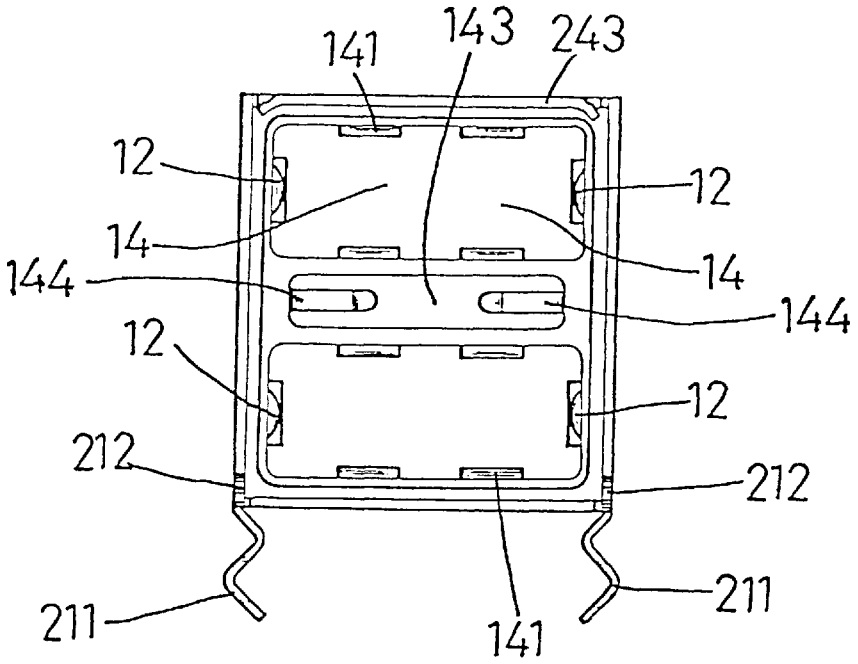
FIG. 5 is a rear view of the connector socket shown in FIG. 1.

Referring to FIGS. 1 to 6, the connector socket made according to the present invention generally comprises a seamless front housing 10 that has square or rectangular cross section. The perimeter of the front housing 10 is provided with a plurality of recesses 12 that are directed inward to the housing 10. The front portion of the front housing 10 is provided with at least one receptacle 14 that is provided with a plurality of positioning tabs 141 that has a arcuate contour The rear housing 20 is connected to the rear portion of the front housing 10 and which has a square or rectangular cross section. The rear housing 20 defines left and right walls 21, 22 that are provided with at least an opening 23. The top wall 24 of the rear housing 20 has a longer length than that of the left and right walls 21, 22 and a bending cutout 241 is disposed adjacent to the left and right walls 21. 22. The rear end of the top wall 24 is also provided with a retaining groove 242 at both sides. The bottom wall 25 of the rear housing 20 has a shorter length that equals to the length of the left and right walls 21, 22, as clearly shown in FIG. 3.

From the forgoing description, the bulk size of the front housing 10 can be designed to equal or smaller than that of the rear housing 20. According to the forgoing description, the upper and lower receptacles 14 are divided by a partitioning slot 143 and which is provided with resilient tabs 144 at both sides. Those resilient tabs 144 are directed inward.

According to another aspect of the present invention, the lower end of the left and right walls 21, 22 are provided with connecting legs 211, 212, respectively. The lower rear end of the left and right walls 21, 22 are also provided with a retaining tab 212, respectively.

According to another aspect of the present invention, the top wall 24 can be folded downward along the bending cutouts 241 such that the rear opening of the rear housing 20 can be completely enclosed or sealed by the rear section 243 of the top wall 24. When the rear section 243 is folded and positioned, the retaining tabs 212 of the left and right walls 21, 22 can be completely engaged with the retaining grooves 242 located on the rear section 243 of the rear wall 24.

From the forgoing description, the connector socket can be concluded with the following advantages when it is actually practiced.

Figure 6:
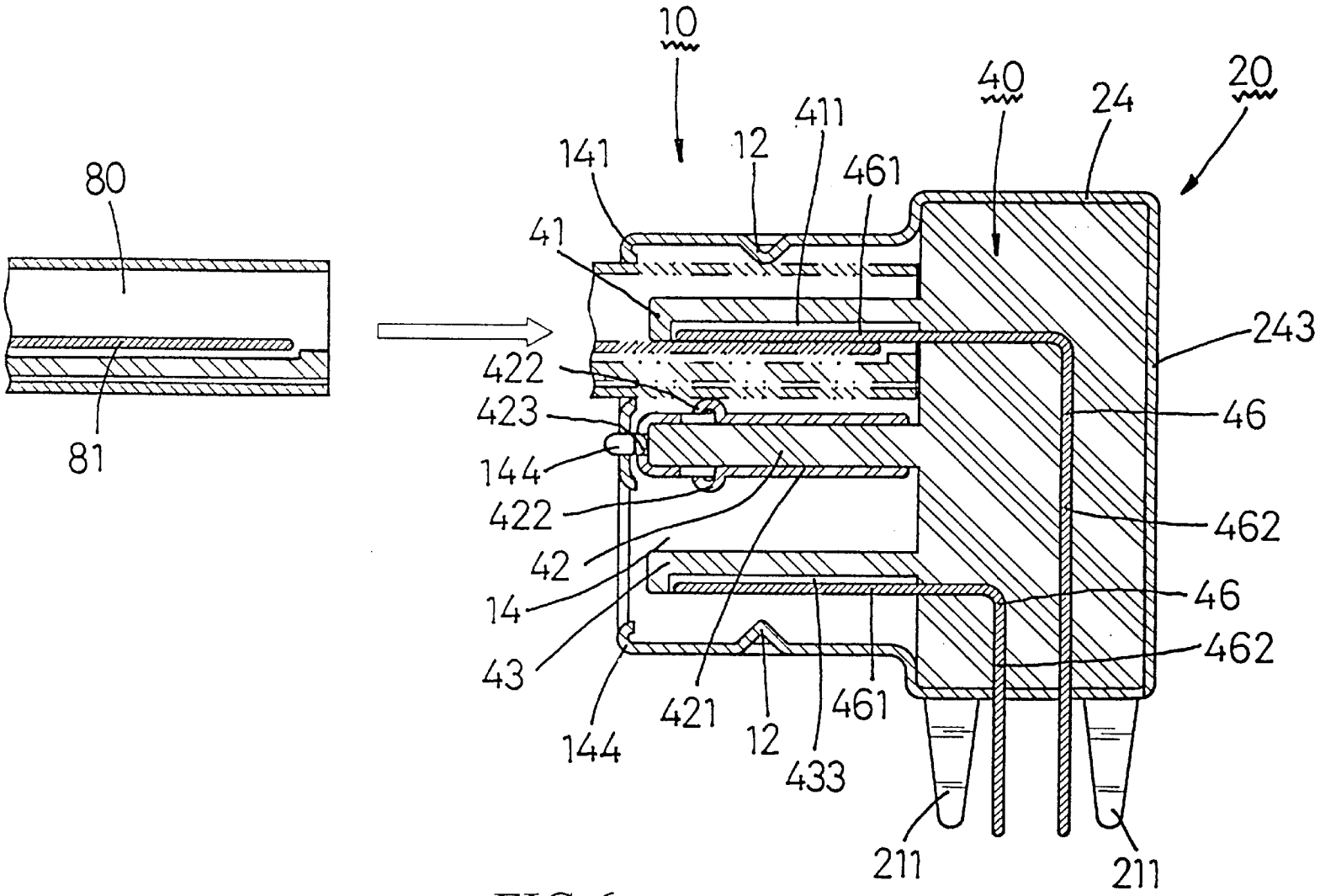
FIG. 6 is a cross sectional view of the connector socket in which a connector is retained thereof.
Figure 8:
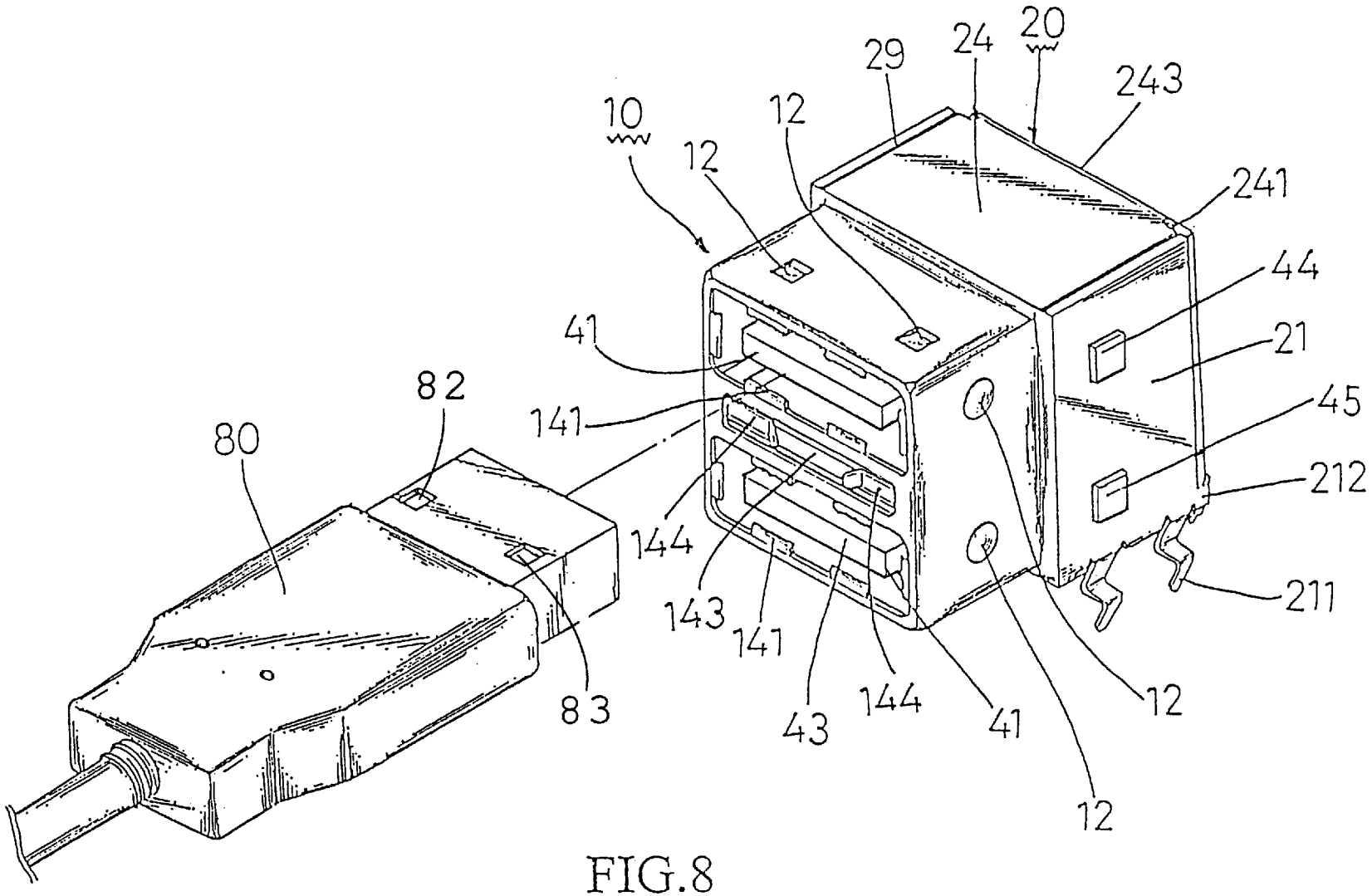
FIG. 8 is an exploded perspective view showing the connector socket and the connector.

1. Referring to FIGS. 6 and 8, when the rear section 243 is completely folded, the rear opening of the rear housing 20 can be completely sealed. By this arrangement, the conducting pins assembly 40 that has been received and retained within the front housing 10 can be completely protected from entry of dust. When the connector 80 is inserted into the receptacle 14, by the provision of the positioning tabs 141 and recesses 12 received in grooves 82 and 83, the connector 80 can be accurately and firmly inserted into the conducting pins 41.

2. The conducting pin assembly 40 is housing made from plastic material.

Figure 7:
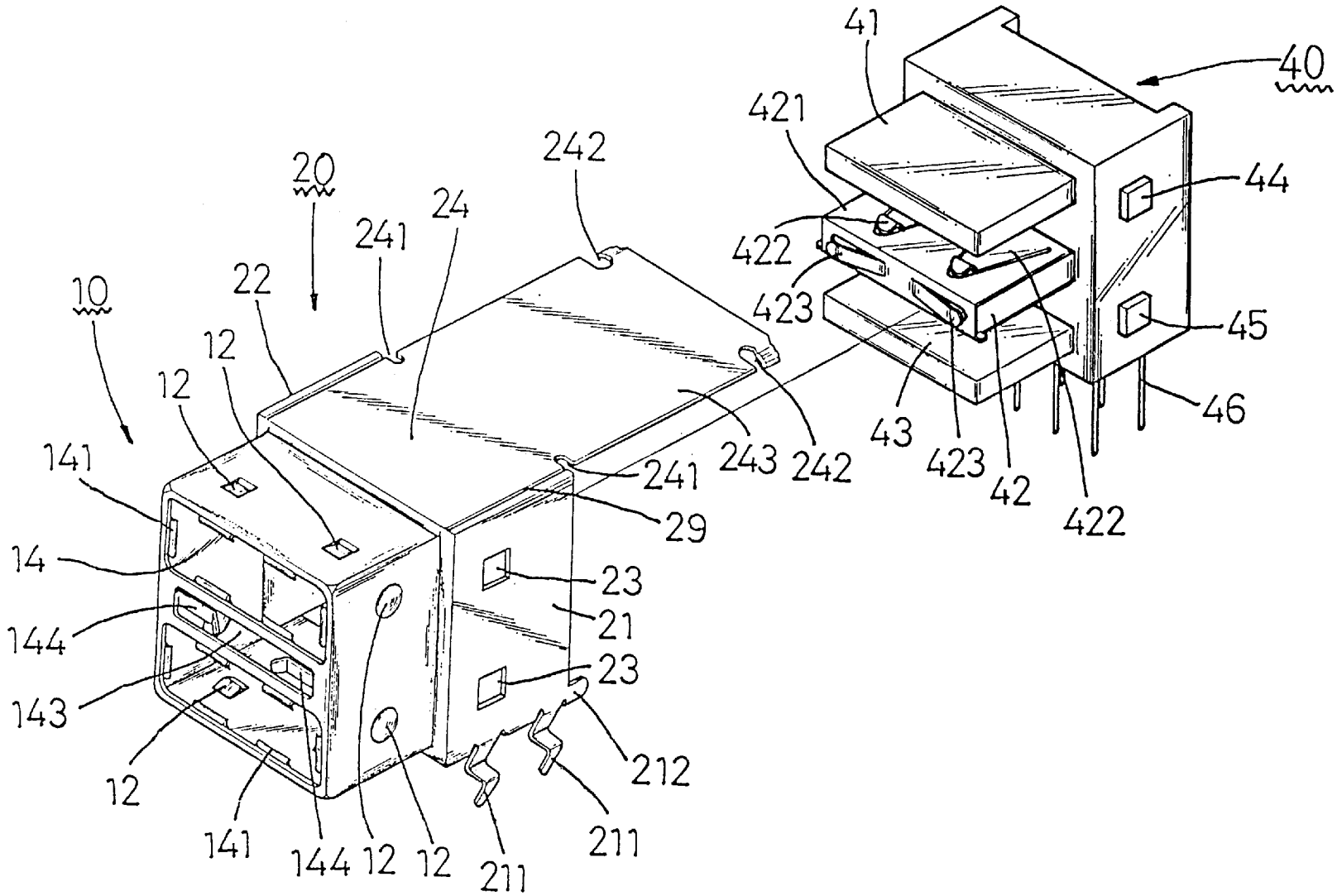
FIG. 7 is an exploded perspective view showing the connector socket and the conducting element.

The front section is divided into two layers. i.e. the upper layer 41, middle layer 42, and lower layer 43. The rear end of the conducting pins assembly 40 is provided with a pair of projections 44, 45, respectively The upper and lower perimeters of the middle layer 42 are covered with metal plate 421 that is provided with a retaining tab 422 at upper and lower surfaces, respectively. The front end of the metal plate 421 is further provided with resilient retaining tabs 423. The upper and lower layers 41, 43 are provided with an elongate slot 411, 433 respectively. A plurality of L-shape terminals 46 that defines a horizontal portion 461 and a vertical portion 462. The horizontal portion 461 of the L-shape terminals 46 are disposed within the elongate slots 411, 433 and the vertical portions 462 are projected over the conducting pin assembly 40. The conducting pin assembly 40 is fixedly retained and positioned within the front housing 10. When the conducting pin assembly 40 is positioned, the upper, middle, and lower layers 41, 42, and 43 are disposed within the front housing 10 such that the upper and lower layers 41 and 43 are aligned with the upper and lower receptacles 14, respectively, while the metal plate 421 of the middle layer 42 is aligned with the partitioning slot 143 and the outer retaining tab 423 is engaged with the resilient tabs 144. In this case, the left and right outer portion of the upper and lower layers 41, 43 are engaged with the recesses 12 such that the upper and lower layers 41, 43 are prevented from traverse displacement when that are exerted with force. On the other hand, those two projections 44, 45 are received within the openings 23 and are projected therefrom. In this case, the conducting pin assembly 40 is fixedly and integrally connected with the front and rear housings 10, 20 respectively Referring to FIGS. 6 and 7, when the connector 80 is inserted into the receptacle 14, the conducting terminals 81 will be electrically contacted with the horizontal portion 461 of the terminals 46. A electrically conducting path is established thereof most important, by the provision of the recesses 12 and the retaining tabs 422 that are engaged with the top and bottom surfaces of the connector 80, the connector 80 can be accurately and fixedly retained and positioned within the receptacle 14. This may benefit an effective and accurate connection between the horizontal portion 461 and the terminals 81. Besides, as the rear section 243 is bent downward to enclose the rear opening of the rear housing 20, the conducting pin assembly 40 is therefore completely enclosed. Consequently, the conducting pin assembly 40 can be fixedly and correctly disposed within the front and rear housings 10 and 20 without any play thereof The unwanted displacement is therefore completely eliminated.

Figure 9:
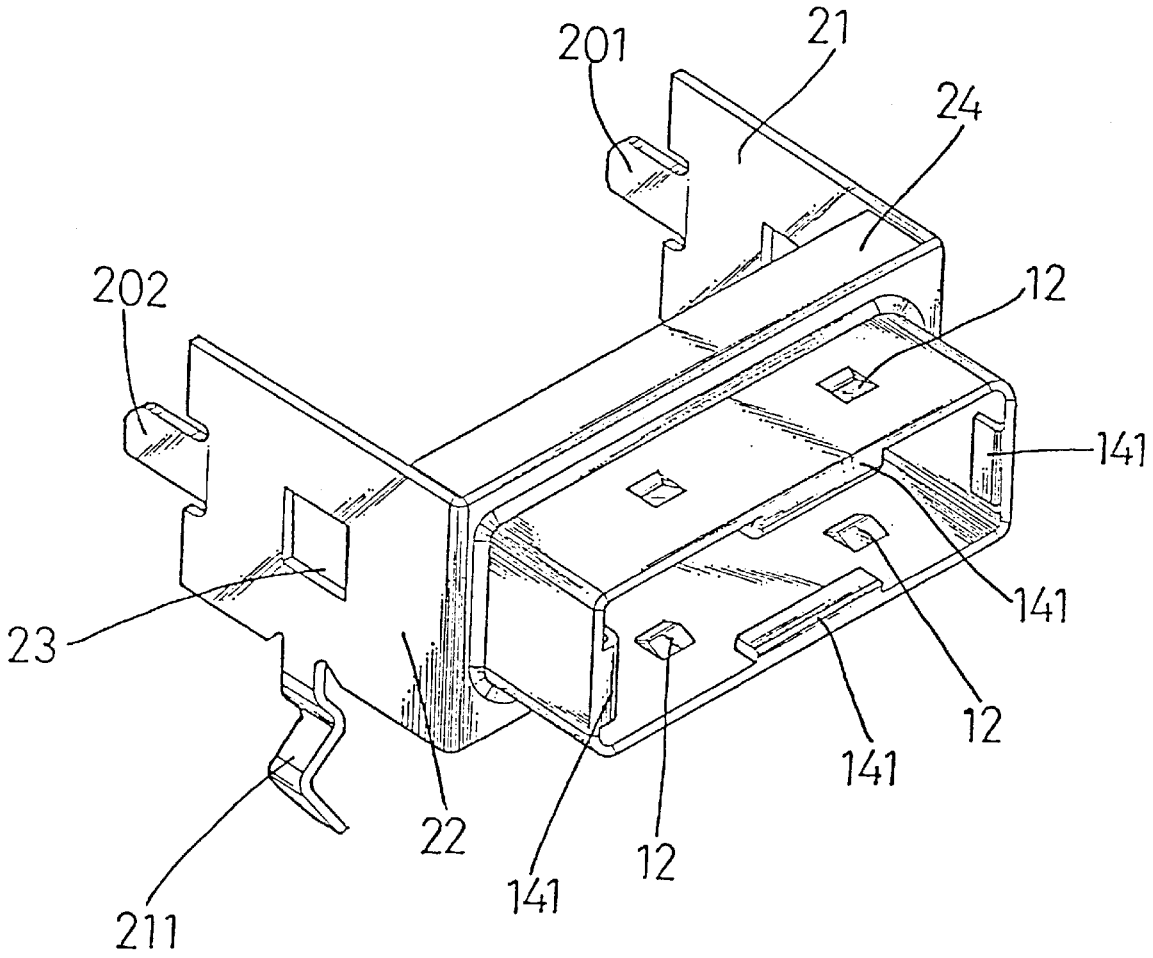
FIG. 9 is another embodiment of the connector socket made according to the present invention.
Figure 10:
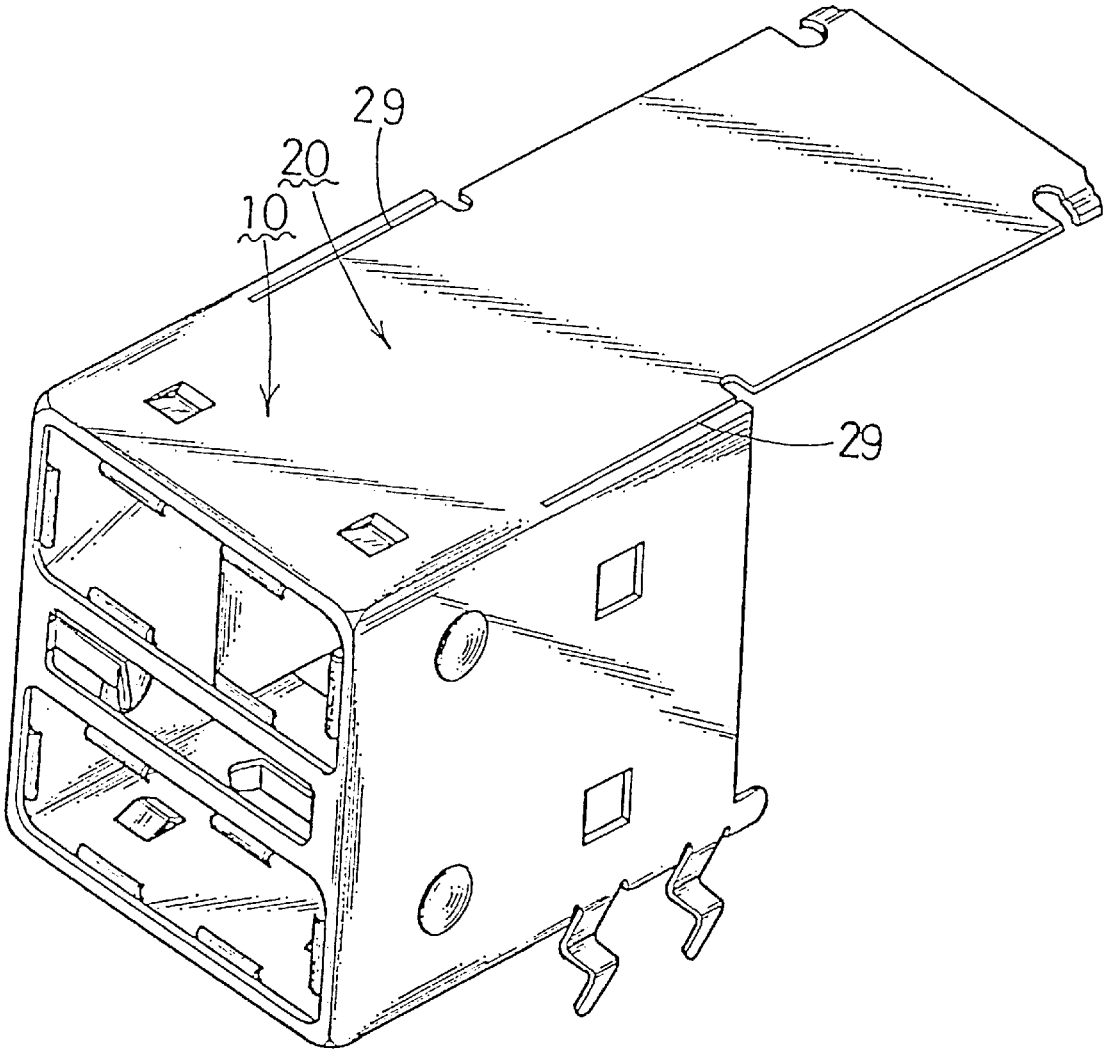
FIG. 10 is a perspective view of the connector socket shown in FIG. 1 and in which rear housing is designed to same with the front housing.
Figure 11:
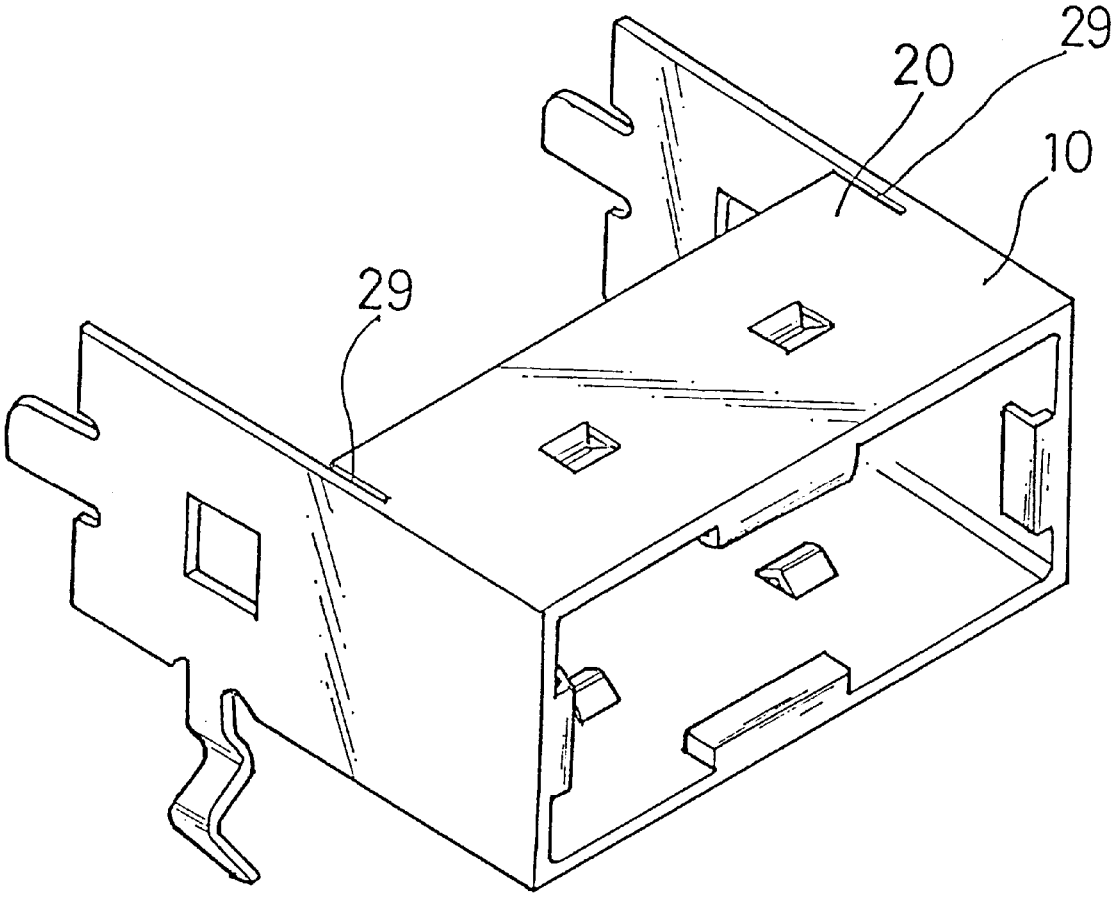
FIG. 11 is a perspective view of the connector socket shown in FIG. 9 and in which the rear-housing is designed to same with the front housing.
Figure 12A:
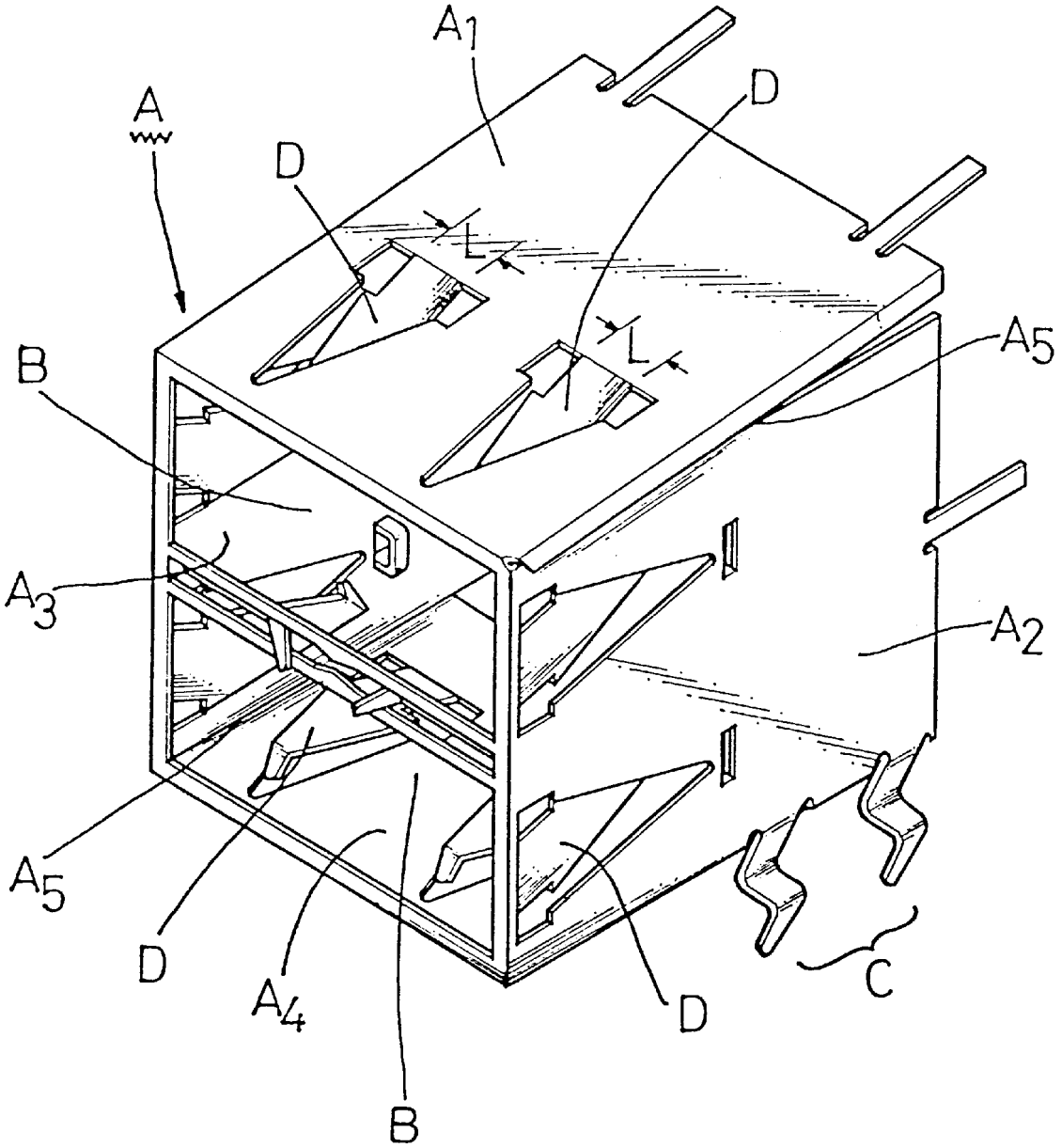
FIG. 12A is a perspective view of an advanced connector socket.
Figure 12B:
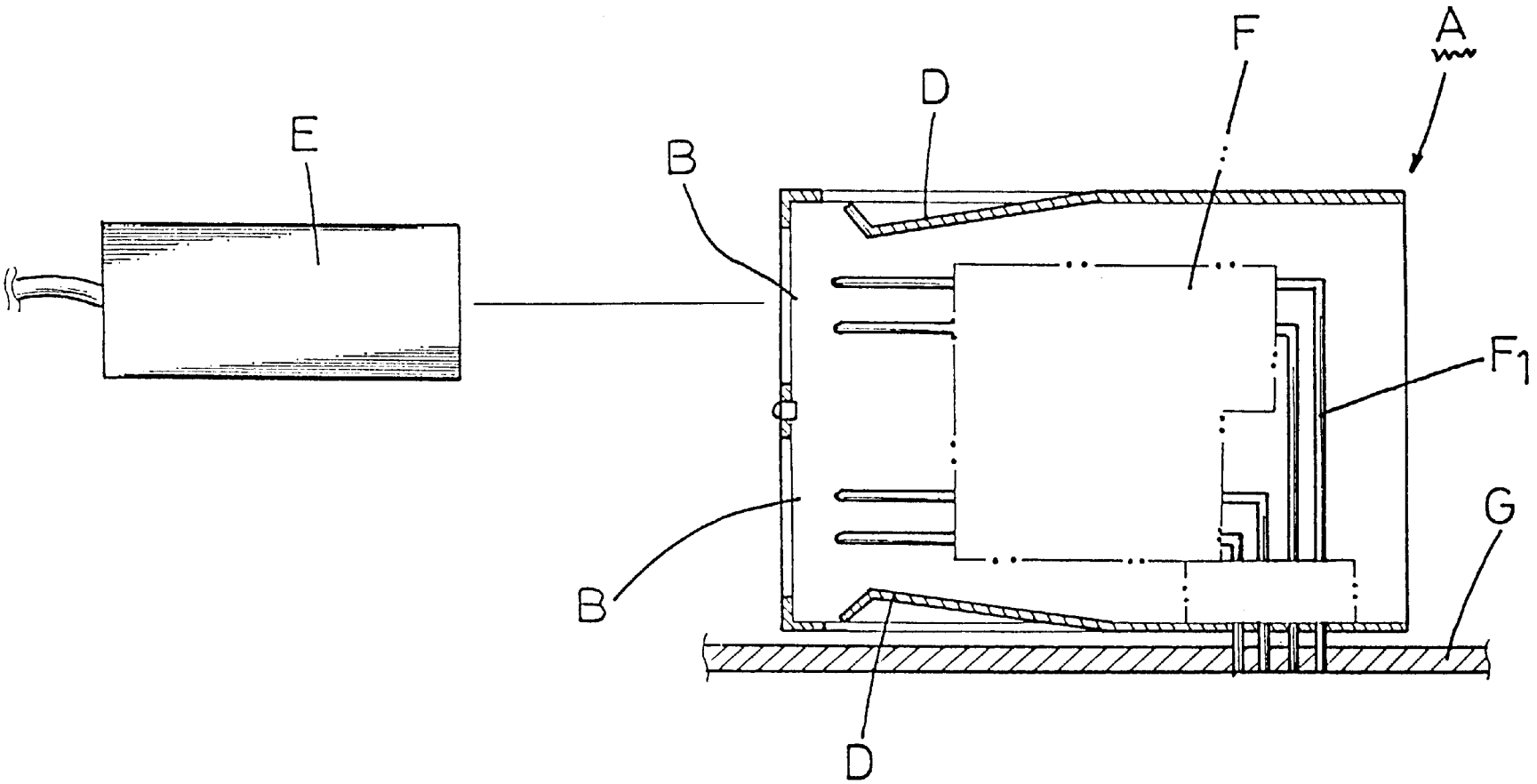
FIG. 12B is a sectional view of the connector socket.
Figure 13:
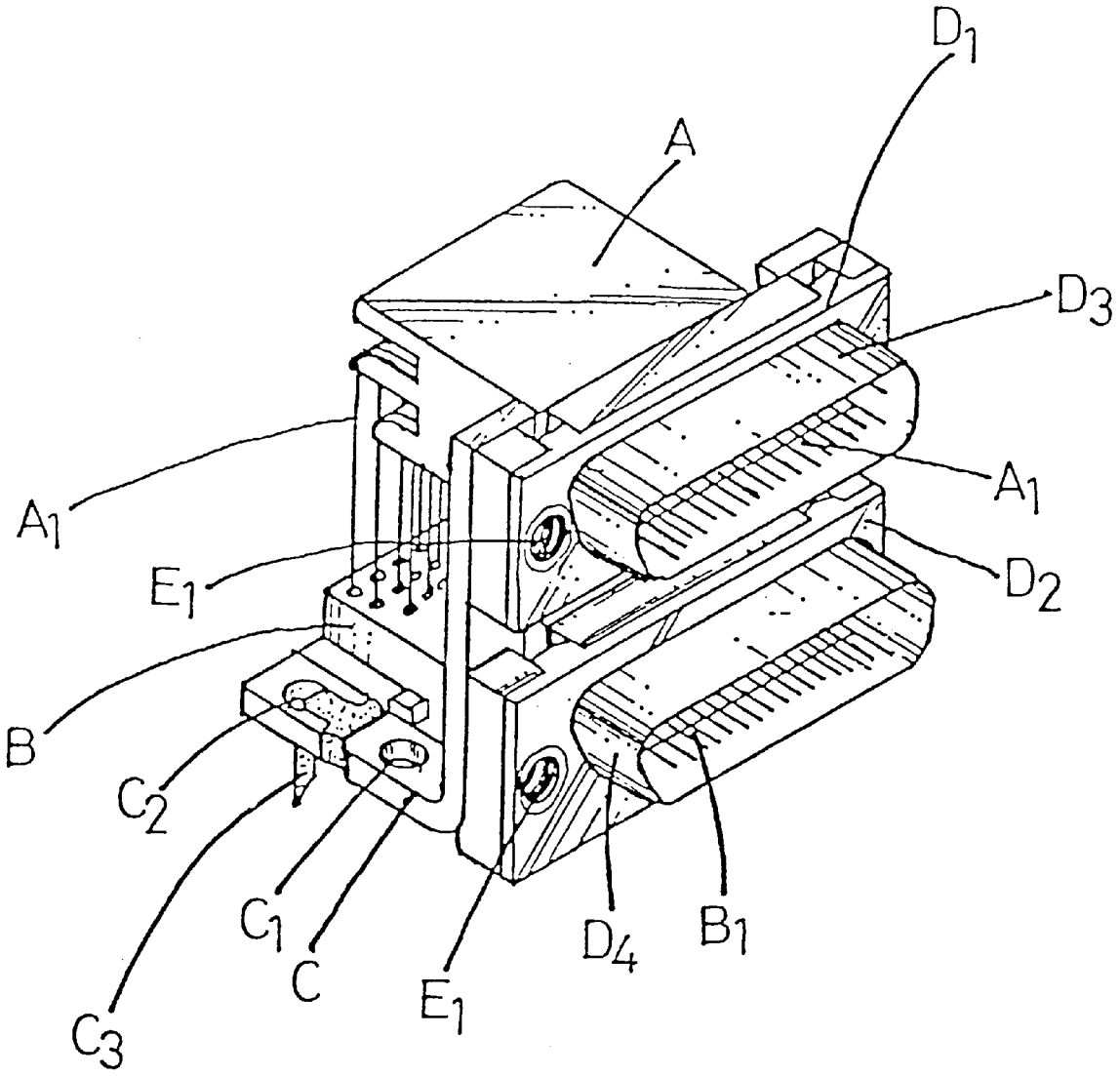
FIG. 13 is a perspective view of the conventional connector socket.

3. Referring to FIG. 9, the front housing 10 can be only provided with a single receptacle 14. In this embodiment, the left and right walls 21, 22 is provided with a retaining plate 201, 202 respectively and that can be used to a retain the conducting pin assembly 40 thereof (not shown). However, the configuration of this embodiment is completely identical to that of the embodiment that has two receptacles. As shown in FIGS. 10, 11 the buck size of the front housing 10 and the rear housing 20 are completely same.

While particular embodiments of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

We claim:

1. An improved electrical connector socket comprising:

a conductive seamless front housing having a front portion and a rear portion in a rectangular cross section, said front portion having at least an upper and a lower receptacle said front housing having an outer wall with a plurality of recesses directly extending inwardly in said receptacles, a plurality of contoured positioning tabs in said housing surrounding the receptacles therein, and, a partitioning slot disposed between the upper and lower receptacles and a resilient tab disposed at ends of said partitioning slot;

a conductive rear housing being connected to the rear portion of said front housing and having a rectangular cross section, said rear housing having top, bottom, left and right walls, said left and right walls each having at least one opening therein, the top wall of said rear housing having a length that is longer than the length of said left, right and bottom walls, said top wall having bending cutouts being disposed adjacent to said left and right walls, and a rear end portion of said top wall being provided with a retaining groove at both sides therein.

* * * * *